US008900012B2

(12) United States Patent
Zhu et al.

(10) Patent No.: US 8,900,012 B2
(45) Date of Patent: Dec. 2, 2014

(54) USB CONNECTOR APPARATUS

(71) Applicant: Huawei Device Co., Ltd., Shenzhen, Guangdong (CN)

(72) Inventors: Sheng Zhu, Shenzhen (CN); Qizhi Zhan, Shenzhen (CN)

(73) Assignee: Huawei Device Co., Ltd., Shenzhen (CN)

( * ) Notice: Subject to any disclaimer, the term of this patent is extended or adjusted under 35 U.S.C. 154(b) by 0 days.

(21) Appl. No.: 13/657,767

(22) Filed: Oct. 22, 2012

(65) Prior Publication Data

US 2013/0045629 A1 Feb. 21, 2013

Related U.S. Application Data

(63) Continuation of application No. PCT/CN2011/073037, filed on Apr. 20, 2011.

(30) Foreign Application Priority Data

Apr. 20, 2010 (CN) ..... 2010 2 0170362 U

(51) Int. Cl.
*H01R 9/03* (2006.01)
*H01R 13/6582* (2011.01)

(52) U.S. Cl.
CPC ..... *H01R 13/6582* (2013.01)
USPC ..... 439/607.55

(58) Field of Classification Search
USPC ..... 439/352–353, 607.4–607.59, 660
See application file for complete search history.

(56) References Cited

U.S. PATENT DOCUMENTS 5,658,170 A 8/1997 Tan et al.
5,938,476 A 8/1999 Wu et al.

(Continued)

FOREIGN PATENT DOCUMENTS

CN 2678164 Y 2/2005
CN 201289647 Y 8/2009

(Continued)

OTHER PUBLICATIONS

Extended European Search Report in corresponding European Patent Application No. 11771577.1 (Jul. 9, 2013).

(Continued)

*Primary Examiner* — Edwin A. Leon
(74) *Attorney, Agent, or Firm* — Leydig, Voit & Mayer, Ltd.

(57) ABSTRACT

An improved Universal Serial Bus (USB) connector apparatus is provided. In one embodiment, the USB connector apparatus comprises a top wall; a bottom wall having one or two openings; two side walls; an internal cavity with a rectangular cross section enclosed by the top wall, the bottom wall and the two side walls; a gasket disposed within the internal cavity; and a first connecting piece made of a conductive material and positioned at the one or more openings of the bottom wall and at least partially covering the one or more openings of the bottom wall, wherein the top wall, bottom wall, two side walls, internal cavity and gasket are configured to comply with a USB interface standard. The USB connector apparatus ensures that a bottom wall elastic sheet of the USB socket effectively contacts with the bottom wall of the USB connector, thereby providing higher grounding performance. Further, it improves on the conventional USB connector without much additional cost.

2 Claims, 4 Drawing Sheets

(56) References Cited

U.S. PATENT DOCUMENTS

| | | | | |
|---|---|---|---|---|
| 6,896,527 | B1 | 5/2005 | Peng | |
| 6,948,983 | B1 * | 9/2005 | Peng | 439/660 |
| 7,004,794 | B2 * | 2/2006 | Wang et al. | 439/660 |
| 2003/0119362 | A1 | 6/2003 | Nelson et al. | |
| 2003/0157836 | A1 | 8/2003 | Morikawa et al. | |
| 2006/0094301 | A1 | 5/2006 | Lee et al. | |
| 2007/0077818 | A1 | 4/2007 | Iwakawa | |
| 2008/0200058 | A1 * | 8/2008 | Tsai | 439/353 |
| 2009/0053932 | A1 | 2/2009 | Zhou et al. | |

FOREIGN PATENT DOCUMENTS

| | | | |
|---|---|---|---|
| CN | 201608292 | U | 10/2010 |
| CN | 201629421 | U | 11/2010 |
| JP | 2003243093 | A | 8/2003 |
| JP | 2005510848 | A | 4/2005 |
| JP | 2006128061 | A | 5/2006 |
| JP | 2007103104 | A | 4/2007 |

OTHER PUBLICATIONS

Written Opinion of the International Searching Authority in corresponding PCT Patent Application No. PCT/CN2011/073037 (Apr. 20, 2011).

International Search Report for International application No. PCT/CN2011/073037, dated Jul. 21, 2011, 4 pages total.

1st Office Action in corresponding Japanese Patent Application No. 2013-502995 (Oct. 22, 2013).

* cited by examiner

USB CONNECTOR APPARATUS

CROSS-REFERENCE TO RELATED APPLICATIONS

This application is a continuation of International Application No. PCT/CN2011/073037, filed on Apr. 20, 2011, which claims priority to Chinese Patent Application No. 201020170362.2, filed on Apr. 20, 2010, and entitled "USB PLUG, USB CONNECTING STRUCTURE, AND WIRELESS TERMINAL", both of which are hereby incorporated by reference in their entireties.

FIELD OF THE INVENTION

Embodiments of the present relate to the field of communications technologies, and in particular, to an improved USB plug.

BACKGROUND OF THE INVENTION

A USB (Universal Serial Bus) interface is a common connecting interface. A conventional USB connecting structure includes a USB socket and a USB plug. The USB plug is inserted into the USB socket when being used, so that an external device is in electrical conduction with a computer to transmit data or supply power to the external device. The USB socket is also called a USB female socket; and the USB plug is also called a USB male connector. The structure of the USB socket is usually as that shown in FIG. 1, and the structure of the USB plug is usually as that shown in FIG. 2 and FIG. 3.

As shown in FIG. 1, the USB socket includes an interface 101 with a rectangular cross section formed by a top wall, a bottom wall and two side walls, and has one opening for the USB plug to insert into. As shown in FIG. 1, two top wall elastic sheets 102 are disposed at the top wall; two bottom wall elastic sheets 103 are also disposed at the bottom wall, and one side wall elastic sheet 104 is also disposed at each of the two side walls. As shown in FIG. 1, a card 105 is disposed at the opening of the USB socket, a preset distance exists between the periphery of the card 105 and four walls of the interface, and a metal connecting sheet (not shown in the figure) is disposed at a side of the card 105 that fits the USB plug.

As shown in FIG. 2, the USB plug includes a frame body with a rectangular cross section formed by a top wall, a bottom wall and two side walls 202, and has one opening to insert into the USB socket as shown in FIG. 1. As shown in FIG. 2 and FIG. 3, two openings 212 are disposed at the top wall of the interface of the USB plug, and two openings are disposed the bottom wall. As shown in FIG. 4, the openings 212 run through the top wall, the openings disposed at the bottom wall run through the bottom wall, and they adapt to the locations of the top wall elastic sheets 102 and the bottom wall elastic sheets 103 as shown in FIG. 1. As shown in FIG. 2, a gasket 203 is disposed in the USB plug. A bottom surface of the gasket 203 contacts with the bottom wall, a preset distance exists between a top surface of the gasket 203 and the top wall, and a metal connecting sheet 204 is disposed at the top surface of the gasket 203.

In this way, when the USB plug inserts into the USB socket, the card of the USB socket inserts between the gasket of the USB plug and the top wall so that the metal connecting sheet of the bottom surface of the card contacts with and is in conduction with the metal connecting sheet of the top surface of the gasket, so as to realize data transmission or power supply. The top wall elastic sheets of the USB socket are engaged into two openings of the top wall of the USB plug; and two bottom wall elastic sheets are engaged into two openings of the bottom wall of the USB plug, so as to realize grounding.

SUMMARY OF THE INVENTION

Embodiments of the present invention address a problem in conventional USB plugs, specifically that when a USB plug is inserted into a USB socket, the bottom wall elastic sheets of the USB socket cannot effectively contact a bottom wall of the USB plug, thereby resulting in reduced electromagnetic compatibility (EMC) performance of the associated USB device, especially if the device is a wireless terminal.

An embodiment of the present invention provides a USB connector apparatus, which includes: a top wall; a bottom wall having one or more openings; two side walls; an internal cavity with a rectangular cross section enclosed by the top wall, the bottom wall and the two side walls; a gasket disposed within the internal cavity; and a first connecting piece made of a conductive material and positioned at the one or more openings of the bottom wall and at least partially covering the one or more openings of the bottom wall, wherein the top wall, bottom wall, two side walls, internal cavity and gasket are configured to comply with a USB interface standard.

Another embodiment of the present invention provides a USB connector apparatus, which includes: a top wall having one or more openings; a bottom wall; two side walls; an internal cavity with a rectangular cross section enclosed by the top wall, the bottom wall and the two side walls; a gasket disposed within the internal cavity; and a first connecting piece made of a conductive material and positioned at the one or more openings of the top wall and at least partially covering the one or more openings of the top wall, wherein the top wall, bottom wall, two side walls, internal cavity and gasket are configured to comply with a USB interface standard.

BRIEF DESCRIPTION OF THE DRAWINGS

To illustrate the technical solutions according to the embodiments of the present invention more clearly, the accompanying drawings for describing the embodiments are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

To make the objectives, technical solutions and advantages of the present invention clearer, the embodiments of the present invention are described in detail in the following with reference to the accompanying drawings.

Figure 4:
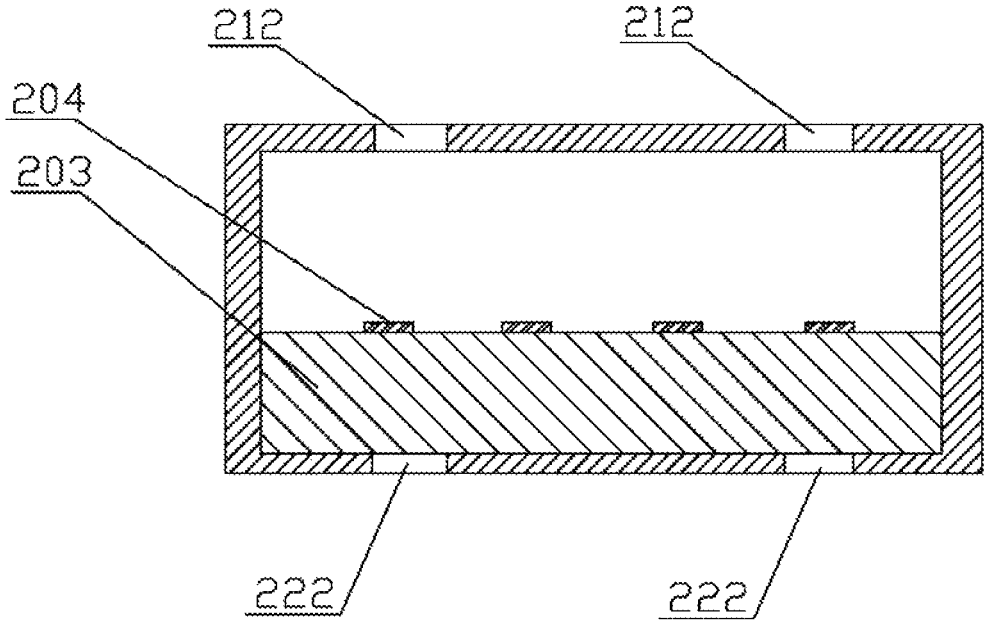
FIG. 4 (Prior Art)
FIG. 4 is a vertical cross-sectional structural diagram of the USB plug shown in FIG. 2 and FIG. 3.

A conventional USB plug is shown in FIG. 4, a gasket 203 is disposed at an internal cavity of the interface, a bottom of the gasket 203 contacts with the bottom wall, and a preset distance exists between a top of the gasket and the top wall. When no connecting piece exists in the conventional art, the bottom wall elastic sheet passes through the opening 222 disposed at the bottom wall to directly contact with the gasket 203 shown in FIG. 4, so that the bottom wall elastic sheet cannot contact with or be in electrical conduction with the bottom wall, and the grounding performance is poor.

Because the gasket of an internal cavity of the USB plug contacts with the bottom wall of the interface of the USB plug, the bottom wall elastic sheets of the USB socket are affected by the gasket of the USB plug when the USB plug inserts into the USB socket. As a result, the bottom wall elastic sheets of the USB socket cannot enter the openings of the bottom wall of the USB plug as being squeezed by the gasket, and the bottom wall elastic sheets of the USB socket cannot contact with the bottom wall of the USB plug.

For a wireless device, grounding affects the wireless performance greatly. Therefore, the bottom wall elastic sheets of the USB socket in the existing USB plug and the USB connecting structure cannot contact with the bottom wall of the USB plug, which may reduce the performance of EMC (electromagnetic compatibility) of the wireless device.

The following embodiments of the present invention address the above-described problem. At the same time, the structure of these embodiments may be conveniently obtained through modification of a conventional USB plug without much additional cost.

Embodiment 1

Figure 5:
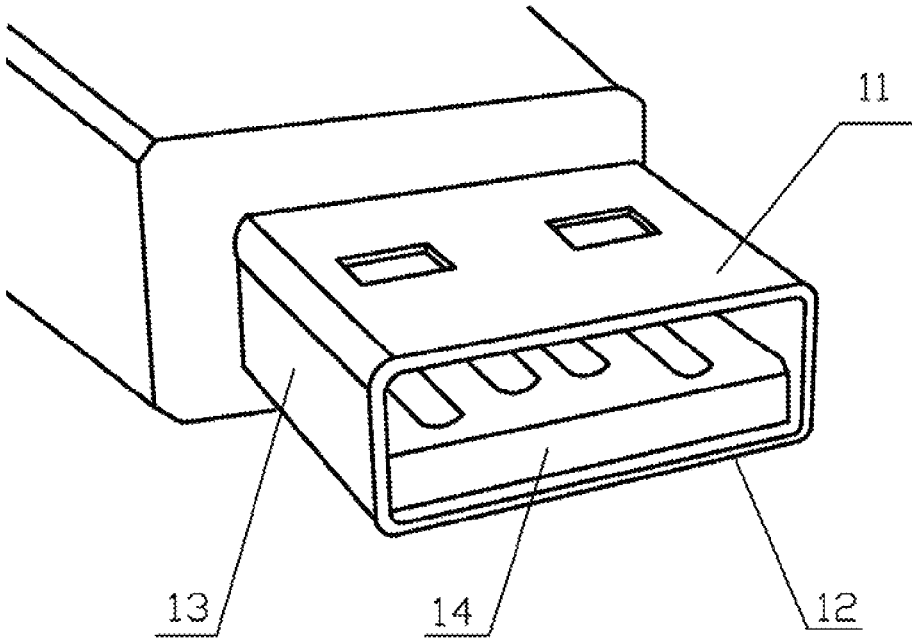
FIG. 5 is a schematic structural diagram of a USB plug in accordance with an embodiment of the present invention.
Figure 6:
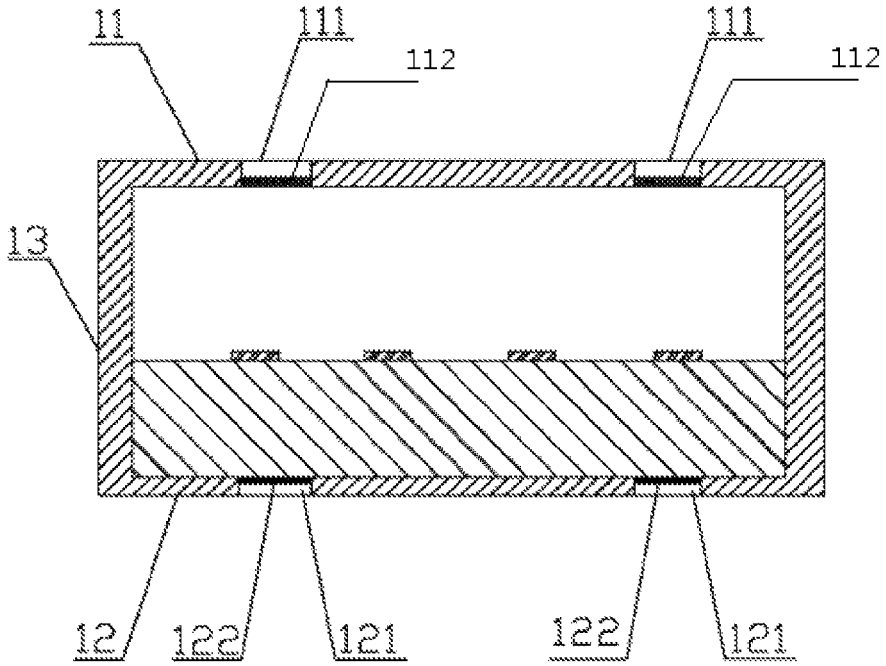
FIG. 6 is a cross-sectional structural diagram illustrating a connecting piece in accordance with an embodiment of the present invention.
Figure 7:
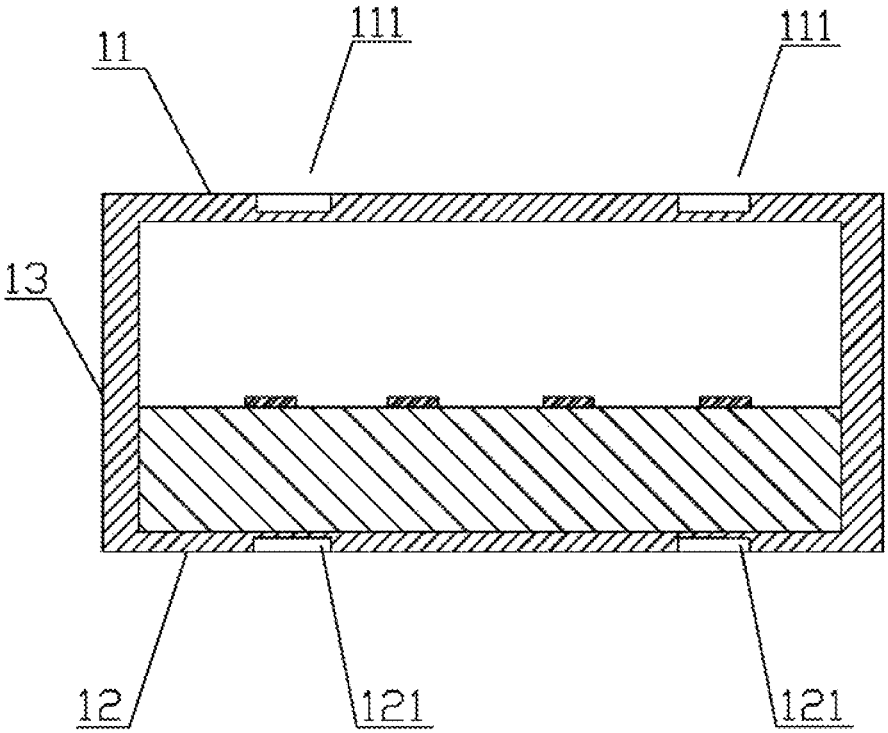
FIG. 7 is a cross-sectional structural diagram illustrating a connecting piece in accordance with another embodiment of the present invention.

Embodiment 1 of the present invention provides a USB plug. As shown in FIG. 5, the USB plug has an interface, where the interface includes a top wall 11, a bottom wall 12, and two side walls 13. As shown in FIG. 6, and FIG. 7, the bottom wall 12 has one or more openings 121. The interface also includes a connecting piece, the connecting piece is located at the openings 121 of the bottom wall 12, the connecting piece covers the opening 121 and is connected to the bottom wall 12, and the connecting piece is made of conductive material.

Embodiment 1 of the present invention provides a USB plug, by disposing a connecting piece at the openings of the bottom wall of the USB plug, when the USB plug is connected to a USB socket, a bottom wall elastic sheet of the USB socket may contact with the connecting piece. The connecting piece is in electrical conduction with the bottom wall, so it may be ensured that the bottom wall elastic sheet contacts with the connecting piece, and therefore the bottom wall elastic sheet is conduction with the bottom wall, and the grounding performance is ensured.

Embodiment 2

Figure 8:
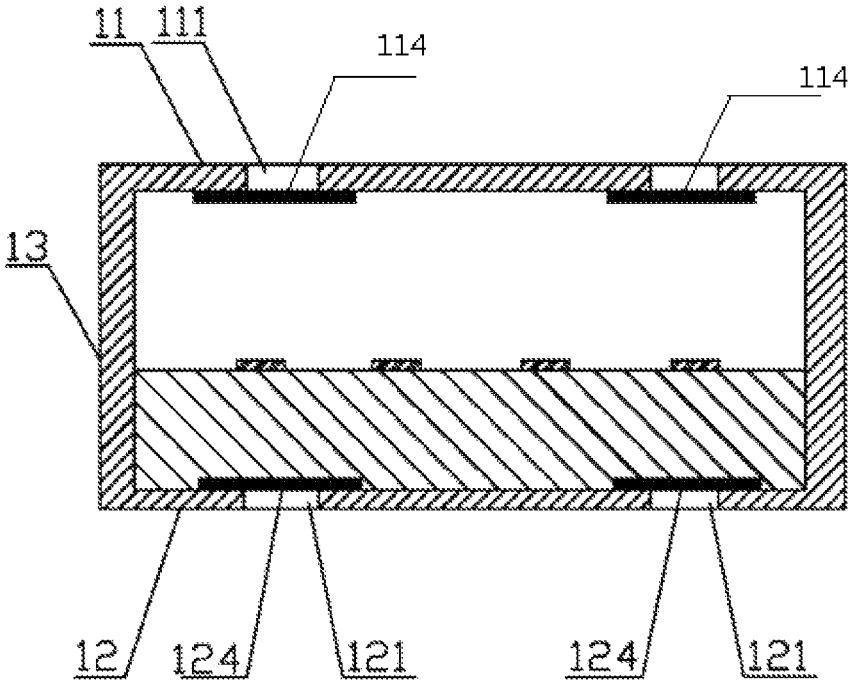
FIG. 8 is a cross-sectional structural diagram illustrating a connecting piece in accordance with yet another embodiment of the present invention.

Embodiment 2 of the present invention provides a USB plug, which is obtained through improvement on the basis of Embodiment 1. Not only a bottom wall may adopt the structure of the connecting piece, but also a top wall may adopt the structure, thereby further ensuring the reliability of grounding. As shown in FIG. 6, FIG. 7, and FIG. 8, on the basis of Embodiment 1, one or more openings 111 are added on a top wall 111, a connecting piece may also be disposed at the openings 111, and the connecting piece covers the opening 111 and is in electrical conduction with the top wall 11.

The connecting piece of the top wall and the bottom wall may be of multiple structures, and the bottom wall is taken as an example:

For example, as shown in FIG. 6, the opening 121 runs through the bottom wall 12, the connecting piece is a metal piece 122 adapting to the shape of the opening 121 shown in FIG. 6, and the periphery of the metal piece 122 is fixedly connected to and in electrical conduction with the bottom wall 12. The shape of the metal piece 122 adapts to the shape of the opening 121 so that the metal piece 122 is embedded into the opening 121, and a side wall of the metal piece 122 is fixed to a side wall of the opening of the bottom wall 121 so that the opening is covered by the metal piece. Because the bottom wall 12 has certain thickness, the side wall of the metal piece 122 and the side wall of the bottom wall 12 may be welded or fixed together in other manners, so that they are in electrical conduction with each other. This structure may be conveniently obtained by modification on the basis of the prior USB plug, and may be obtained without modifying the prior manufacture equipment in a large scale. The metal piece 122 may be a metal sheet with certain thickness, and may also be a metal sheet that may be bent to form one side wall. Similarly, a metal piece 112 may be disposed in the opening 111 located in the top wall 11.

For another example, as shown in FIG. 7, the connecting piece may be a recess of an outer surface of the bottom wall 12. The opening 121 does not run through the bottom wall 12. The bottom wall 12 has certain thickness, so a recess may be formed on the outer surface of the bottom wall 12, and the thickness of the recess is smaller than the thickness of the bottom wall 12. The recess may be used as the connecting piece. This structure may have a good connection effect, and further improve the reliability of grounding. The recess of the outer surface of the bottom wall 12 may be integrally formed when making the USB plug.

For another example, as shown in FIG. 8, the opening 121 runs through the bottom wall 12. As shown in FIG. 8, the connecting piece may be a metal piece 124, and the area of the metal piece 124 is larger than the area of the opening 121 shown in FIG. 6. The metal piece 124 is disposed at the bottom of the gasket 14, and the location of the metal piece adapts to the opening 121. The location of the metal piece 124 adapts to the location of the opening 121, in this way, when the gasket 14 and the bottom wall 12 are being assembled, the metal piece 124 can cover the opening 121. The area of the metal piece 124 is larger than the area of opening 121, so the metal piece 124 can contact with and be in electrical conduction with the bottom wall 12. The metal piece 124 may be fixed on the bottom wall 12 in a way, such as by welding, and the metal piece 124 may be tightly pressed against the bottom wall 12 through the gasket 14. Similarly, a metal piece 114 may be disposed in the opening 111 located in the top wall 11.

The embodiment of the present invention is not limited thereto. This structure may be conveniently obtained by modification on the basis of the prior USB plug, and may be obtained without modifying the prior manufacture equipment in a large scale. The metal piece 124 may be a metal sheet with certain thickness, and may also be a thin metal sheet.

Certainly, the foregoing connecting pieces are only examples taken for description of the embodiment of the present invention, and the embodiment of the present invention is not limited thereto. The connecting piece in the embodiment of the present invention may also be in other forms, for example, may be a metal bump on the bottom surface of the gasket 14, and the metal bump may cover the opening 121. The metal bump is connected to the bottom wall 12. Persons skilled in the art should understand that, the forgoing methods and variations of the methods can all implement the function of the connecting piece in Embodiment 1 of the present invention, and the structures should fall within the protection scope of the present invention.

At the same time, in the embodiment of the present invention, as shown in FIG. 6, FIG. 7, and FIG. 8, the top wall 11 has one or more openings 111, and the connecting piece may also be set to cover the opening 111. The connecting piece on the top wall may also be any one or multiple structures shown in FIG. 6, FIG. 7, and FIG. 8. At the same time, the top wall and the bottom wall each may adopt any one or multiple structures of the foregoing three methods, or other structures, and the embodiment of the present invention is not limited thereto.

Embodiment 3

Figure 1:
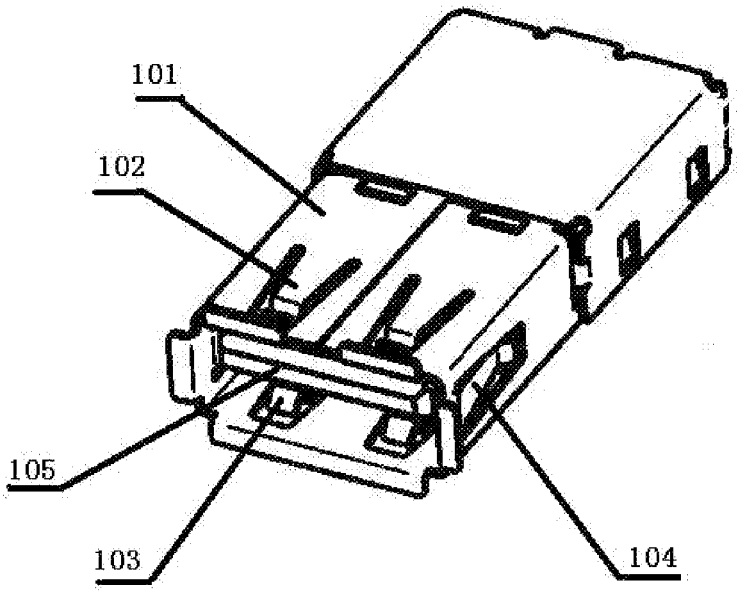
FIG. 1 (Prior Art)
FIG. 1 is a schematic three-dimensional structural diagram of a conventional USB socket.
Figure 2:
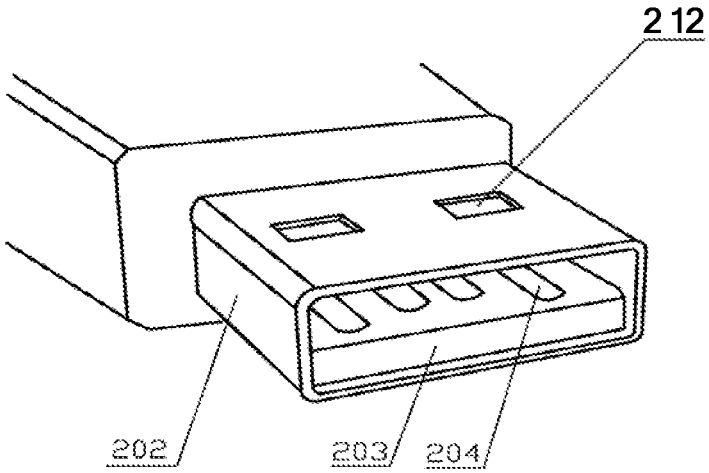
FIG. 2 (Prior Art)
FIG. 2 is a schematic three-dimensional structural diagram of a conventional USB plug.
Figure 3:
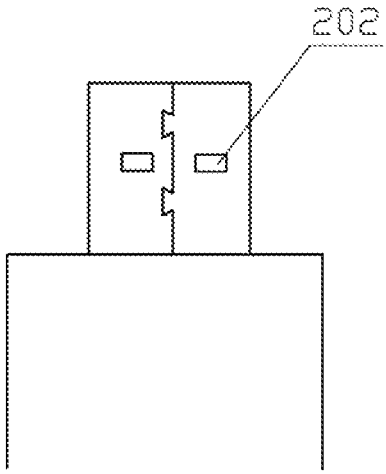
FIG. 3 (Prior Art)
FIG. 3 is a schematic structural diagram of a bottom view of the USB plug shown in FIG. 2.

Embodiment 3 of the present invention provides a USB connecting structure which includes a USB socket shown in FIG. 1. The USB socket has a socket interface 101, where the socket interface 101 includes a top wall, a bottom wall and two side walls, one or more bottom wall elastic sheets 103 are disposed at the bottom wall. The USB connecting structure also includes a USB plug. As shown in FIG. 5, the USB plug has an interface 1, where the interface 1 includes a top wall 11, a bottom wall 12, and two side walls 13. As shown in FIG. 5, FIG. 6, and FIG. 7, the bottom wall 12 has one or more openings 121. The interface also includes a connecting piece, the connecting piece covers the opening 121 and is connected to the bottom wall 12, and the connecting piece is made of conductive material.

Embodiment 3 of the present invention provides a USB plug, by disposing a connecting piece at an opening of a bottom wall of the USB plug, in this way, when the USB plug is connected to a USB socket, the bottom wall elastic sheet of the USB socket may contact with the connecting piece. The connecting piece is in electrical conduction with the bottom wall, so it may be ensured that the bottom wall elastic sheet contacts with the connecting piece, and therefore the bottom wall elastic sheet is in conduction with the bottom wall, and the grounding performance is ensured. A prior USB plug is shown in FIG. 4, a gasket 203 is disposed at an internal cavity of the interface, a bottom of the gasket 203 contacts with the bottom wall, and a preset distance exists between a top of the gasket and the top wall. When no connecting piece exists in the conventional art, the bottom wall elastic sheet passes through an opening 222 to directly contact with the gasket 203 shown in FIG. 4, so that the bottom wall elastic sheet cannot contact with or be in electrical conduction with the bottom wall, and the grounding performance is poor. Embodiment 3 of the present invention solves the problem, and at the same time, this structure may be conveniently obtained through improvement on the basis of the prior USB plug without much additional cost.

Embodiment 4

Embodiment 4 of the present invention provides a USB connecting structure, which is obtained through improvement on the basis of Embodiment 3. Not only a bottom wall may adopt the structure of the connecting piece, but also a top wall may adopt the structure, thereby further ensuring the reliability of grounding. As shown in FIG. 6, FIG. 7, and FIG. 8, one or more openings 111 exist on the top wall 11, a connecting piece may also be disposed at the openings 111, and the connecting piece covers the opening 111 and is in electrical conduction with the top wall 11.

The connecting piece of the top wall and the bottom wall may be of multiple structures, and the bottom wall is taken as an example:

For example, as shown in FIG. 6, the opening 121 runs through the bottom wall 12. As shown in FIG. 6, the connecting piece is a metal piece 122 adapting to the shape of the opening 121 shown in FIG. 6, and the periphery of the metal piece 122 is fixedly connected to and in electrical conduction with the bottom wall 12. The shape of the metal piece 122 adapts to the shape of the opening 121 so that the metal piece 122 is embedded into the opening 121, and a side wall of the metal piece 122 is fixed to a side wall of the opening of the bottom wall 121 so that the metal piece covers the opening. Because the bottom wall 12 has certain thickness, the side wall of the metal piece 122 and the side wall of the bottom wall 12 may be welded or fixed together in other manners, so that they are in electrical conduction with each other. This structure may be conveniently obtained by modification on the basis of the prior USB plug, and may be obtained without modifying the prior manufacture equipment in a large scale. The metal piece 122 may be a metal sheet with certain thickness, and may also be a metal sheet that may be bent to form a side wall.

For another example, as shown in FIG. 7, the connecting piece may be a recess of an outer surface of the bottom wall 12. The opening 121 does not run through the bottom wall 12. Because the bottom wall 12 has certain thickness, a recess may be formed on the outer surface of the bottom wall 12, and the thickness of the recess is smaller than the thickness of the bottom wall 12. The recess may be used as the connecting piece. This structure may have a good connection effect, and further improve the reliability of grounding.

For another example, as shown in FIG. 8, the opening 121 runs through the bottom wall 12. As shown in FIG. 8, the connecting piece may be a metal piece 124, and the area of the metal piece 124 is larger than the area of the opening 121 shown in FIG. 6. The metal piece 124 is disposed at the bottom of the gasket 14, and the location of the metal piece adapts to the opening 121. The location of the metal piece 124 adapts to the location of the opening 121, in this way, when the gasket 14 and the bottom wall 12 are being assembled, the metal piece 124 can cover the opening 121. The area of the metal piece 124 is larger than the area of opening 121, so the metal piece 124 can contact with and be in electrical conduction with the bottom wall 12. The metal piece 124 may be fixed on the bottom wall 12 in a way, such as by welding, and the metal piece 124 may be tightly pressed against the bottom wall 12 through the gasket 14.

The embodiment of the present invention is not limited thereto. This structure may be conveniently obtained by modification on the basis of conventional USB plug, and may be obtained without modifying the prior manufacture equipment in a large scale. The metal piece 124 may be a metal sheet with certain thickness, and may also be a thin metal sheet.

Certainly, the foregoing connecting pieces are only examples taken for description of the embodiment of the present invention, and the embodiment of the present invention is not limited thereto. The connecting piece in the embodiment of the present invention may also be in other forms, for example, may be a metal bump on the bottom surface of the gasket 14, and the metal bump may cover the opening 121. The metal bump is connected to the bottom wall 12. Persons skilled in the art should understand that, the forgoing methods and variations of the methods can all implement the function of the connecting piece in Embodiment 3 of the present invention, and the structures should fall within the protection scope of the present invention.

At the same time, in the embodiment of the present invention, as shown in FIG. 6, FIG. 7, and FIG. 8, the top wall 11 has one or more openings 111, and the connecting piece may also be set to cover the opening 111. The connecting piece on the top wall may also be any one or multiple structures shown in FIG. 6, FIG. 7, and FIG. 8. At the same time, the top wall and the bottom wall each may adopt any one or multiple structures of the foregoing three methods, or other structures, and the embodiment of the present invention is not limited thereto.

It may be seen from the foregoing embodiments that embodiments of the present invention provide a USB plug by disposing a connecting piece at the opening of the bottom wall of the USB plug, and in this way, when the USB plug is connected to the USB socket, the bottom wall elastic sheet of the USB socket may contact with the connecting piece. The connecting piece is in electrical conduction with the bottom wall, so the problem that the bottom wall elastic sheet may contact with the gasket when being connected so that the bottom wall elastic sheet cannot contact with the bottom wall may be addressed. At the same time, this structure may be conveniently obtained through improvement of a conventional USB plug without much additional cost.

The above descriptions are merely exemplary embodiments of the present invention, but are not intended to limit the present invention. Any modification, equivalent replacement, or improvement made without departing from the spirit and principle of the present invention should fall within the protection scope of the present invention.

What is claimed is:

1. A Universal Serial Bus (USB) connector apparatus, comprising:

a top wall;

a bottom wall made of a conductive material;

two side walls;

an internal cavity with a rectangular cross section enclosed by the top wall, the bottom wall and the two side walls; and a gasket disposed within the internal cavity;

wherein the top wall, the bottom wall, the two side walls, the internal cavity and the gasket are configured to comply with a USB interface standard, wherein a bottom of the gasket contacts with an inner surface of the bottom wall, wherein one or two recesses are formed on an outer surface of the bottom wall, wherein a bottom wall elastic sheet of a USB socket contacts with the one or two recesses when the USB connector apparatus is inserted into the USB socket to realize grounding; and wherein a thickness of the one or more recesses formed on the outer surface of the bottom wall is smaller than a thickness of the bottom wall.

2. A Universal Serial Bus (USB) connector apparatus, comprising:

a top wall;

a bottom wall made of a conductive material;

two side walls;

an internal cavity with a rectangular cross section enclosed by the top wall, the bottom wall and the two side walls; and a gasket disposed within the internal cavity;

wherein the top wall, the bottom wall, the two side walls, the internal cavity and the gasket are configured to comply with a USB interface standard, wherein a bottom of the gasket contacts with an inner surface of the bottom wall, wherein one or two recesses are formed on an outer surface of the bottom wall, wherein a bottom wall elastic sheet of a USB socket contacts with the one or two recesses when the USB connector apparatus is inserted into the USB socket to realize grounding;

wherein the top wall is made of a conductive material and has one or two recesses formed on a outer surface of the top wall, and a top wall elastic sheet of the USB socket contacts with the one or two recesses of the top wall when the USB connector apparatus is inserted into the USB socket to realize grounding; and wherein a thickness of the one or more recesses formed on the outer surface of the top wall is smaller than a thickness of the top wall.

* * * * *